US008863623B2

(12) United States Patent
Nashimoto

(10) Patent No.: US 8,863,623 B2
(45) Date of Patent: Oct. 21, 2014

(54) OPEN-CLOSE WORK IMPLEMENT

(75) Inventor: Masami Nashimoto, Sanjo (JP)

(73) Assignee: Nashimoto Industries Co., Ltd., Niigata (JP)

( * ) Notice: Subject to any disclaimer, the term of this patent is extended or adjusted under 35 U.S.C. 154(b) by 249 days.

(21) Appl. No.: 13/395,774

(22) PCT Filed: Dec. 10, 2010

(86) PCT No.: PCT/JP2010/072277
§ 371 (c)(1),
(2), (4) Date: Mar. 13, 2012

(87) PCT Pub. No.: WO2012/053123
PCT Pub. Date: Apr. 26, 2012

(65) Prior Publication Data

US 2012/0291293 A1 Nov. 22, 2012

(30) Foreign Application Priority Data

Oct. 19, 2010 (JP) ..... 2010-234143

(51) Int. Cl.
*B25B 7/02* (2006.01)
*B25G 1/00* (2006.01)
*B25B 7/12* (2006.01)
*B25B 7/00* (2006.01)

(52) U.S. Cl.
CPC .... *B25B 7/12* (2013.01); *B25B 7/00* (2013.01)
USPC ..... 81/417; 81/415

(58) Field of Classification Search
CPC ..... B25B 7/00; B25B 7/02; B25B 7/06; B25B 7/08; B25B 7/10; B25B 7/18; B25B 9/02; A45D 26/0066
USPC ..... 81/342, 415–417; 294/3, 8.4, 99.1, 294/99.2; 606/133, 210; 30/191, 272.1
See application file for complete search history.

(56) References Cited

U.S. PATENT DOCUMENTS 3,282,137 A * 11/1966 Lovelace ..... 81/302
3,653,389 A * 4/1972 Shannon ..... 606/210

(Continued)

FOREIGN PATENT DOCUMENTS

| | | |
|---|---|---|
| FR | 2 775 504 A1 | 9/1999 |
| GB | 2 334 693 A | 9/1999 |
| JP | 62-89948 U | 6/1987 |

OTHER PUBLICATIONS

International Search Report for PCT/JP2010/072277 dated Mar. 8, 2011.

(Continued)

*Primary Examiner* — David B Thomas
(74) *Attorney, Agent, or Firm* — Sughrue Mion, PLLC

(57) ABSTRACT

An open-close work implement is provided, wherein an object can be easily held without being damaged by a simple operation of merely gripping or squeezing the open-close operation part (5) with the fingertips. A first half member (1) and a second half member (2) are intersected and pivotally fitted together, an open-close working part (4) is provided to the distal end, and an open-close operation part (5) is provided to the proximal end. When increasing closing force is applied to the open-close operation part, the open-close operation part flexes and a contact part (7) and a receiving part (6) come in contact. Even though the closing force is further increased while the receiving part and the contact part are in a state of contact, the closing force is not transmitted to the open-close working part, and the holding force of the open-close working part does not increase.

7 Claims, 10 Drawing Sheets

(56) References Cited

U.S. PATENT DOCUMENTS

| | | | | |
|---|---|---|---|---|
| 3,675,359 | A | 7/1972 | Ohno | |
| 3,906,957 | A * | 9/1975 | Weston | 606/205 |
| 5,451,231 | A * | 9/1995 | Rabenau et al. | 606/138 |
| 5,522,290 | A * | 6/1996 | Visser et al. | 81/427 |
| 5,893,307 | A * | 4/1999 | Tao | 81/427 |
| 6,050,279 | A * | 4/2000 | Goad | 134/201 |
| 6,263,770 | B1 | 7/2001 | Gomas et al. | |
| 2001/0015561 | A1 * | 8/2001 | Tseng | 294/16 |
| 2012/0132040 | A1 * | 5/2012 | Mastroianni | 81/427 |

OTHER PUBLICATIONS

English Translation of International Preliminary Report on Patentability for PCT/JP2010/072277 dated Apr. 25, 2013.

Chinese Official Action, dated Mar. 5, 2014, issued in corresponding Chinese Patent Application No. 201080040939.0.

* cited by examiner

OPEN-CLOSE WORK IMPLEMENT

CROSS REFERENCE TO RELATED APPLICATIONS

This application is a National Stage of International Application No. PCT/JP2010/072277 filed Dec. 10, 2010, claiming priority based on Japanese Patent Application No. 2010-234143 filed Oct. 19, 2010, the contents of all of which are incorporated herein by reference in their entirety.

TECHNICAL FIELD

The present invention relates to an open-close work implement in which closing force applied to an open-close operation part is transmitted to an open-close working part and an object is held or cut by this open-close working part.

BACKGROUND ART

Pincers, nippers, and other conventional open-close work implements have used the principle of leverage to change the gripping force of an operator gripping an open-close operation part to a greater holding force or cutting force, which is transmitted to an open-close working part to hold or cut an object.

Therefore, it has been common for the rigidity and strength of an entire open-close work implement to be increased so that the closing force applied to the open-close operation part by the operator can be transmitted as efficiently as possible to the open-close working part which opens and closes the distal ends of the open-close work implement.

DISCLOSURE OF THE INVENTION

Problems the Invention is Intended to Solve

However, with an open-close work implement in which the primary focus is to ensure rigidity and strength, in cases in which the object being held has a delicate structure, such that a greater amount of holding force than necessary is readily applied to the open-close working part performing the opening and closing action, e.g., the object is easily crushed, destroyed, or scratched on the surface. There have been occasions in which the closing force applied to the open-close operation part is slightly increased or reduced incorrectly and more force than necessary is applied, whereby more holding force than necessary is applied to the open-close working part and the object is crushed, damaged, or scratched on the surface.

Therefore, the operation of applying closing force to the open-close operation part with delicate increases and reductions has of necessity been sensitive and subtle, requiring all of the operator's concentration in the hand or fingertips so as to avoid crushing, damaging, or scratching the object. The operation has therefore been extremely difficult, involving adjusting the delicate increases and reductions in the force applied to the open-close operation part, and this has caused severe loss of operating efficiency.

In view of this, an object of the present invention is to provide a revolutionary open-close work implement which an operator does not need to carefully operate while adjusting closing force applied to an open-close operation part by delicately increasing or reducing the closing force when an object with a delicate structure which must not be crushed, destroyed, or scratched on the surface is held by a holding operation. For example, an object can be easily held without being crushed, damaged, or scratched on the surface by an extremely simple operation in which the open-close operation part is merely gripped or squeezed with the fingertips.

Means for Solving these Problems

The main points of the present invention are described below with reference to the attached drawings.

The present invention relates to an open-close work implement wherein a first half member 1 and a second half member 2 are intersected and pivotally fitted together, the distal ends being provided with an open-close working part 4 for holding or cutting an object 3, and the proximal ends being provided with an open-close operation part 5 for opening and closing the open-close working part 4; said open-close work implement characterized in being configured so that when closing force is applied to the open-close operation part 5 to close the open-close working part 4 and hold or cut the object 3, the open-close operation part 5 flexes inward as the closing force applied to the open-close operation part 5 is increased while the object 3 is being held; the application of increasing closing force to the open-close operation part 5 is perceived by feeling through a hand gripping the open-close operation part 5 or a hand or fingertips pressing the open-close operation part 5, or by observing the amount of flexure; flexible moving parts 8 of the open-close operation part 5 are provided with a contact part 7 which draws near a receiving part 6 due to the inward flexure of the open-close operation part 5 and contacts the receiving part 6 when the closing force reaches a predetermined value, and when the closing force is further increased while the receiving part 6 and the contact part 7 are in a state of contact, the portion proximal from the contact part 7 further flexes or moves inward but the increased closing force is not transmitted to the open-close working part 5, and the holding force holding the object 3 or the cutting force cutting the object 3 does not increase beyond the holding force or cutting force corresponding to the closing force that was being applied to the open-close operation part 5 at the time the receiving part 6 and the contact part 7 came in contact.

The present invention also relates an open-close work implement wherein a first half member 1 and a second half member constituting a pair are bonded, intersected, and pivotally fitted together at a midway point, the distal ends of the opposing first half member 1 and second half member 2 forming an open-close working part 4 constituting a holding part or cutting part, and the proximal ends of the opposing first half member 1 and second half member 2 forming an open-close operation part 5 for holding or cutting an object 3 when the open-close working part 4 of the distal ends is closed by closing force applied to press the proximal ends towards each other in an inward closing direction; said open-close work implement configured so that when further closing force is applied to the open-close operation part 5 while the object 3 is being held between the distal end of the first half member 1 and the distal end of the second half member 2 constituting the open-close working part 4, at least the proximal end of the first half member 1 or the proximal end of the second half member 2 flexes inward according to the increase in closing force; said open-close work implement also configured so that a contact part 7 which is moved by the flexure and a receiving part 6 contacted by the contact part 7 are provided facing each other to the open-close operation part 5, the contact part 7 is flexibly moved toward the receiving part 6 by increasing the closing force, the contact part 7 contacts the receiving part 6 when the closing force reaches a predetermined value, and when the closing force applied to the open-close operation part 5 continues to be increased further, the portion proximal from the contact part 7 further flexes or moves inward according to the increase in closing force but the increased closing force is not transmitted to the open-close working part 4, and the holding force holding the object 3 or the cutting force cutting the object 3 does not increase beyond the peak value holding force or cutting force corresponding to the closing force that was being applied to the open-close operation part 5 at the time the receiving part 6 and the contact part 7 came in contact.

The present invention also relates to the open-close work implement according to the first aspect, characterized in being configured so that the open-close working part 4 is composed of the distal end of the first half member 1 and the distal end of the second half member 2 for holding or cutting the object 3 by performing a closing action in which the open-close operation part 5, which comprises the proximal end of the first half member 1 and the proximal end of the second half member 2 disposed facing each other, is gripped by a hand or held by fingertips and a gap is narrowed by application of the inward-pressing closing force, and when further closing force is applied to the open-close operation part 5 either while the object 3 is being held between the distal end of the first half member 1 and the distal end of the second half member 2 of the open-close working part 4, or while the object 3 is being held while being cut, at least the first half member 1 or the second half member 2 of the open-close operation part 5 flexes inward; said open-close work implement also configured so that the contact part 7 is provided to one flexible moving part 8 of the first half member 1 or the second half member 2 of the open-close operation part 5, the receiving part 6 is provided to the other opposing flexible moving part 8, the contact part 7 and the receiving part 6 do not come in contact until the open-close working part 4 closes and the object 3 is held, and the flexible moving parts 8 are flexibly deformed by further increasing the closing force holding the object 3, thereby causing the contact part 7 to draw near and contact the receiving part 6; wherein the contact part 7 is provided toward the proximal end from a pivotally fitting part 9 where the first half member 1 and the second half member 2 are intersected and pivotally fitted together, and toward the distal end from a pressure point 10 where the closing force is applied when the open-close operation part 5 is gripped or held by fingertips.

The present invention also relates to the open-close work implement according to the second aspect, characterized in being configured so that the open-close working part 4 is composed of the distal end of the first half member 1 and the distal end of the second half member 2 for holding or cutting the object 3 by performing a closing action in which the open-close operation part 5, which comprises the proximal end of the first half member 1 and the proximal end of the second half member 2 disposed facing each other, is gripped by a hand or held by fingertips and a gap is narrowed by application of the inward-pressing closing force, and when further closing force is applied to the open-close operation part 5 either while the object 3 is being held between the distal end of the first half member 1 and the distal end of the second half member 2 of the open-close working part 4, or while the object 3 is being held while being cut, at least the first half member 1 or the second half member 2 of the open-close operation part 5 flexes inward; said open-close work implement also configured so that the contact part 7 is provided to one flexible moving part 8 of the first half member 1 or the second half member 2 of the open-close operation part 5, the receiving part 6 is provided to the other opposing flexible moving part 8, the contact part 7 and the receiving part 6 do not come in contact until the open-close working part 4 closes and the object 3 is held, and the flexible moving parts 8 are flexibly deformed by further increasing the closing force holding the object 3, thereby causing the contact part 7 to draw near and contact the receiving part 6; wherein the contact part 7 is provided toward the proximal end from a pivotally fitting part 9 where the first half member 1 and the second half member 2 are intersected and pivotally fitted together, and toward the distal end from a pressure point 10 where the closing force is applied when the open-close operation part 5 is gripped or held by fingertips.

The present invention also relates open-close work implement according to any of the first through fourth aspects, characterized in that the portion distal from the pivotally fitting part 9 of the first half member 1 and the second half member 2 constitutes the open-close working part 4, the proximal portion constitutes the open-close operation part 5, the contact part 7 is provided near the pivotally fitting part 9 in a state of protruding inward to either the proximal end of the first half member 1 or the proximal end of the second half member 2 which constitute a gripping part or fingertip-holding part of the open-close operation part 5, and the receiving part 6 which comes in contact with the contact part 7 is provided to the other proximal end.

The present invention also relates to the open-close work implement according to any of the second through fourth aspects, characterized in being configured so that closing force applied to the open-close operation part 5 is transmitted to the open-close working part 4, holding force of the open-close working part 4 for holding the object 3 generated according to the closing force increases according to the increase in the closing force applied to the open-close operation part 5 until the flexible moving parts 8 of the open-close operation part 5 flex and the contact part 7 provided to one flexible moving part 8 draws near and contacts the receiving part 6, and when the closing force applied to the open-close operation part 5 is further increased beyond the point in time when the contact part 7 and the receiving part 6 come in contact, the holding force does not increase according to the increase in closing force applied to the open-close operation part 5, but the holding force decreases after reaching a peak value corresponding to a predetermined value of the closing force at the time of contact between the contact part 7 and the receiving part 6.

The present invention also relates to the manual open-close work implement according to the fifth aspect, characterized in being configured so that closing force applied to the open-close operation part 5 is transmitted to the open-close working part 4, holding force of the open-close working part 4 for holding the object 3 generated according to the closing force increases according to the increase in the closing force applied to the open-close operation part 5 until the flexible moving parts 8 of the open-close operation part 5 flex and the contact part 7 provided to one flexible moving part 8 draws near and contacts the receiving part 6, and when the closing force applied to the open-close operation part 5 is further increased beyond the point in time when the contact part 7 and the receiving part 6 come in contact, the holding force does not increase according to the increase in closing force applied to the open-close operation part 5, but the holding force decreases after reaching a peak value corresponding to a predetermined value of the closing force at the time of contact between the contact part 7 and the receiving part 6.

Effects of the Invention

The present invention is a revolutionary open-close work implement in which, because of the configuration described above, an object to be held or cut can be held without being crushed, damaged, or scratched on the surface by an extremely simple operation of merely holding the object with the open-close working part and simply applying increasing closing force to the open-close operation part.

To be more specific, the open-close work implement of the present invention is used to hold an object having a delicate structure, such that there is concern over the object being crushed, destroyed, or scratched on the surface by the holding operation, there is no need to carefully operate the implement while adjusting the closing operation of the open-close operation part with delicate closing force so as to avoid crushing, breaking, or scratching the surface of the object with the open-close working part; and an object with a delicate structure such as is described above can be held in a simple manner without crushing, breaking, or scratching the surface of the object merely by performing an extremely simple operation of gripping or squeezing with the fingertips, for example.

Specifically, with the open-close work implement of the present invention, since force corresponding to the closing force of the predetermined value or greater applied to the open-close operation part is not transmitted to the open-close working part no matter how much closing force is applied to the open-close operation part, the open-close working part does not hold the object with a holding force equal to or greater than the peak value. Therefore, even if an object is held by the open-close working part by closing force pressing in the closing direction applied by tightly gripping or squeezing the open-close operation part with the fingertips without adjusting any delicate increases or decreases in closing force, for example, this object having a delicate structure can be held without being crushed, damaged, or scratched on the surface.

For example, even when something sensitive which is easily crushed or scratched, such as a blood vessel, is held as the object, the extent of holding force that will crush the object or the extent of holding force that will scratch the object is found in advance, and the peak value of the holding force of the open-close working part is set to a holding force that is not sufficient to crush or damage the surface of the object as found beforehand but is still sufficient to hold the object. There is thus no need for the operator to operate the implement in a troublesome manner such as gripping or squeezing the open-close operation part with the fingertips and carefully increasing the closing force applied to the open-close operation part little by little so as not to transmit too much closing force to the open-close working part, and the open-close operation part need only be gripped or squeezed with the fingertips without any particular worry. Therefore, the revolutionary open-close work implement is capable of holding a blood vessel or other delicate structure prone to being crushed or scratched as the object in an extremely simple and comfortable manner.

Moreover, with this highly practical and revolutionary open-close work implement, the flexure of the open-close operation part is a reaction of elastic force generated by resistance when the object is held or cut. The operator can therefore confirm that the open-close working part has taken hold of the object by feeling the reaction of elastic force from the flexure through the hand or fingertips operating the open-close operation part, and the continued flexing of the open-close operation part causes this elastic force reaction of the flexure to continue to be transmitted to the operator's hand or fingertips. Therefore, the operator can constantly feel that the open-close working part continues to take hold of the object, and consequently, it is possible to ascertain that the object is being held without feeling any unease over whether or not the open-close working part is properly holding the object, and the holding operation can be performed with ease.

BEST MODE FOR CARRYING OUT THE INVENTION

Figure 1:
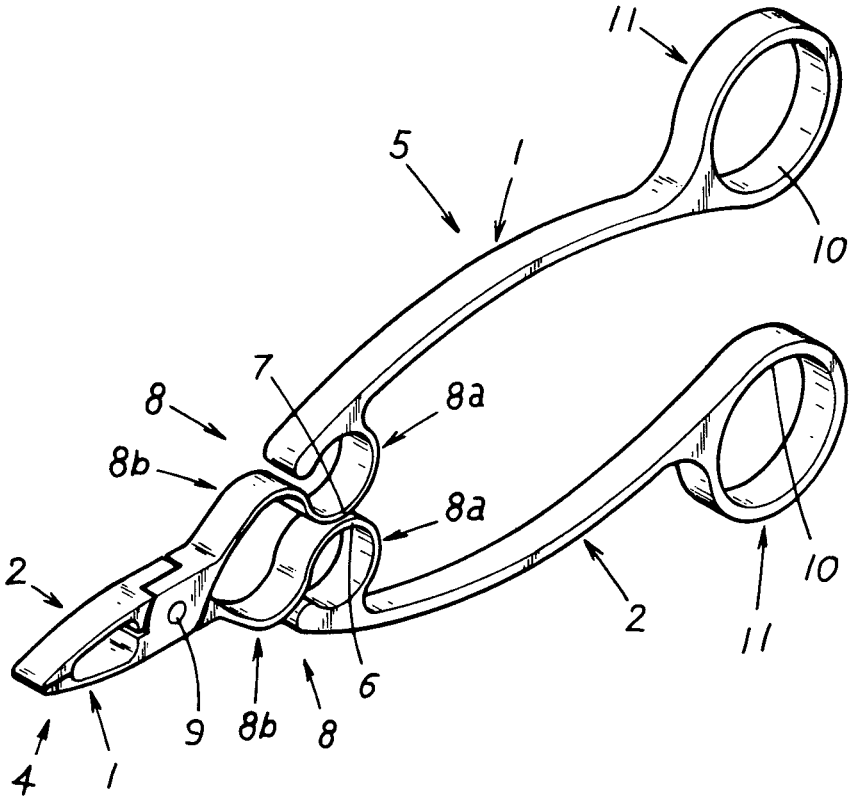
FIG. 1 is a perspective view showing the present example.
Figure 2:
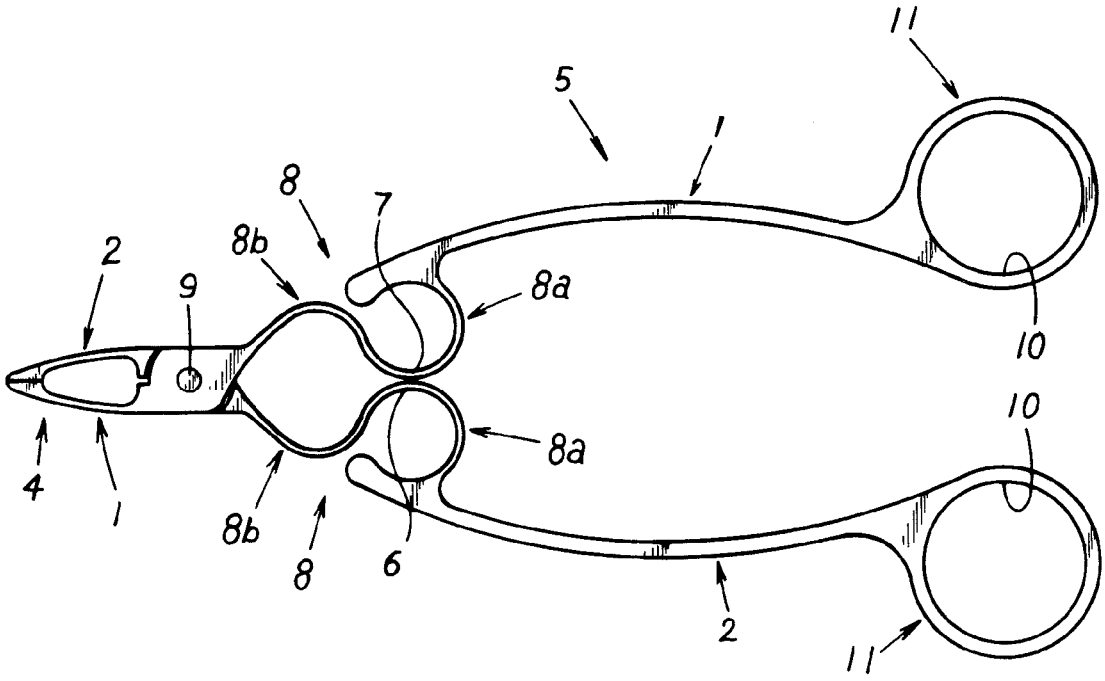
FIG. 2 is a front view showing the present example.

Preferred embodiments of the present invention are briefly described with reference to the diagrams while indicating the effects of the present invention.

When an object 3 is held or cut using the open-close work implement of the present invention, the object 3 is placed in a distal end part between an opposing first half member 1 and second half member 2, i.e., in an open-close working part 4 that is the holding part or cutting part. The proximal end part between the opposing first half member 1 and second half member 2, i.e., an open-close operation part 5 is subjected to a gripping operation or a squeezing operation with the fingertips, for example, and is subjected to closing force which applies pressure in an inward closing direction, whereby the open-close working part 4 closes and holds the object 3.

By applying a further increase of closing force on the open-close operation part 5 while the object 3 is being held by the open-close working part 4, resistance force during the holding or cutting of the object 3 is created at the same time that holding force or cutting force acts on the object 3, and this resistance force causes the open-close operation part 5 to begin to flex inward.

Due to the open-close operation part 5 flexing inward, a contact part 7 provided to a flexible moving part 8 of the open-close operation part 5 draws near a receiving part 6 provided facing the contact part 7.

Thus, the open-close operation part 5 is gripped or squeezed with the fingertips, for example, and the flexure of the open-close operation part 5 occurring when closing force is applied to the open-close operation part 5 is a reaction of elastic force caused by resistance when the object 3 is held or cut by the open-close working part 4. Therefore, an operator can easily perceive that the open-close working part 4 has taken hold of the object 3 by feeling the reaction of elastic force to this flexure with the hand or fingertips operating the open-close operation part 5.

Thus, feeling with the hand or fingertips that the object 3 has been taken hold of by the flexing of the open-close operation part 5, the operator can continue the holding operation with ease. When the closing force on the open-close operation part 5 is further increased, the open-close operation part 5 flexes further inward, the contact part 7 and the receiving part 6 draw nearer together as the open-close operation part 5 flexes, and the contact part 7 contacts the receiving part 6 when the closing force applied to the open-close operation part 5 reaches a predetermined value.

Due to the contact part 7 contacting the receiving part 6, if the closing force applied to the open-close operation part 5 is increased further, the contact part 7 allows the proximal ends of the first half member 1 and second half member 2, i.e., the open-close operation part 5 to flex further inward as the closing force increases, but the contact part 7 does not allow this increasing closing force to be transmitted to the distal ends of the first half member 1 and second half member 2, i.e., to the open-close working part 4.

Specifically, the open-close operation part 5 flexes, whereby the contact part 7 and receiving part 6 provided to the first half member 1 and second half member 2 come in contact, and the contact between the contact part 7 and receiving part 6 suppresses the transmission of closing force to the open-close working part 4. Therefore, the operator can perceive that due to the contact between the contact part 7 and the receiving part 6, the holding force of the open-close working part 4 has reached a peak value and will not increase any further even if more closing force is applied to the open-close operation part 5.

When a state is reached such that the contact part 7 and the receiving part 6 have come in contact and increased closing force is not transmitted to the open-close working part 4 if the closing force applied to the open-close operation part 5 is increased, the result is a state in which, for example, the holding force of the open-close working part 4 remains the same holding force at the time that the contact part 7 and the receiving part 6 came in contact. Specifically, a constant holding force is maintained. In other words, the result is a state in which the holding force at the time of contact between the contact part 7 and the receiving part 6 is a maximum holding force, which is a peak value, and further increasing the closing force applied to the open-close operation part 5 past the time of contact between the contact part 7 and the receiving part 6 causes the holding force of the open-close working part 4 to decrease.

By increasing the closing force applied to the open-close operation part 5 even after the contact part 7 and the receiving part 6 have come in contact, the open-close operation part 5 flexes further, the operator can maintain the state of easy gripping or the state of easy squeezing with the fingertips, and even if closing force is applied to the open-close operation part 5 until such a state of easy gripping or a state of easy squeezing with the fingertips is achieved, a holding force of the peak value or greater does not act on the object 3 held by the open-close working part 4. Therefore, the operator can perform the closing operation on the open-close operation part 5 without worrying over the closing force transmitted from the open-close operation part 5 to the open-close working part 4. In other words, the operator can apply closing force for pressing the open-close operation part 5 of the opposing first half member 1 and second half member 2 in an inward closing direction without any delicate adjustment.

Specifically, since a force equal to or greater than the peak value holding force does not act on the object 3 at the time a predetermined closing force is applied to the open-close operation part 5 and the contact part 7 and receiving part 6 come in contact, the peak value holding force at the time of contact between the contact part 7 and the receiving part 6 is less than the holding force needed to crush or break the object 3 or scratch the surface thereof. The peak value of the holding force is set to be a holding force having enough force to sufficiently hold the object 3, whereby the operator does not need to carefully and slowly operate the implement while delicately adjusting the increase or decrease in closing force applied to the open-close operation part 5 so as not to crush, break, or scratch the surface of the object 3. There is also no need to stop the gripping action with the hand or the squeezing action with the fingertips halfway, for example, and impose a load on the hand or fingers so as to avoid excessive closing force. For example, an object 3 having a delicate structure, such that there is concern over the object being crushed, destroyed, or scratched on the surface by the holding operation, can easily be held with an extremely simple operation wherein the open-close operation part 5 is simply gripped by the hand or the open-close operation part 5 is simply squeezed by the fingertips, and increased closing force is merely applied to the open-close operation part 5. Moreover, the open-close work implement can be operated more speedily than a conventional implement, and the open-close work implement is therefore revolutionary with significantly improved operating efficiency and far superior practicality and operability.

Furthermore, even after the contact part 7 has contacted the receiving part 6 and closing force ceases to be transmitted to the open-close working part 4, the operator can cause the open-close operation part 5 to flex by further gripping the open-close operation part 5 or squeezing it with the fingertips, the operator can approximately perceive how much closing force is being applied to the open-close operation part 5 by feeling the reaction of elastic force created by the flexure through the hand gripping the open-close operation part 5 or the fingers squeezing it, and the operator can also ascertain that the open-close working part 4 continues to take hold of the object 3 and can operate the implement with ease. Furthermore, even in cases in which closing force is applied to the open-close operation part 5 by a device, a robot, or anything else other than a human hand, for example, by observing the amount of flexure in the open-close operation part 5, the operator can feel the increase in closing force through the hand or fingers and at the same time easily perceive that increased closing force is being applied to the open-close operation part 5, and can also perceive that the open-close working part 4 continues to take hold of the object 3.

Therefore, even in cases in which the present invention is used as a surgical tool for holding blood vessels during surgery, for example, holding force that would crush or scratch a blood vessel is ascertained in advance, and the contact part 7 and receiving part 6 are set so as to contact at a predetermined closing force value such that the maximum value (peak value) of holding force transmitted to the open-close working part 4 is a value less than this pre-ascertained holding force that would crush or scratch a blood vessel, holding force equal to or greater than the peak value is thereby prevented from acting on the open-close working part 4, and the operator is therefore relieved of the pressure over possibly crushing a blood vessel when holding the blood vessel. Moreover, when an object such as a blood vessel, which must not be crushed or scratched, is held as the object 3, it is easy to perceive that this object 3 is being held by feeling the increase or decrease in flexure of the open-close operation part 5 through the hand or fingers, there is no unease over whether or not the object 3 is being held with sufficient holding force, and the open-close work implement, which can be used to comfortably and easily hold a blood vessel, is highly practical and revolutionary.

EXAMPLES

Specific examples of the present invention will be described based on the drawings.

The present example is an open-close work implement, configured so that a first half member 1 and a second half member 2 constituting a pair are pivotally fitted in a bonded intersection at a midway point. The distal ends of the opposing first half member 1 and second half member 2 form an open-close working part 4 constituting a holding part or a cutting part. The proximal ends of the opposing first half member 1 and second half member 2 form an open-close operation part 5 for holding or cutting an object 3 when the open-close working part 4 at the distal ends is closed by the closing force which applies pressure in an inward closing direction. When the closing force is further applied to the open-close operation part 5 while the object 3 is being held by the distal end of the first half member 1 and the distal end of the second half member 2 of the open-close working part 4, at least the proximal end of the first half member 1 or the proximal end of the second half member 2 flexes inward according to the increase in closing force. The open-close work implement is also configured so that a contact part 7 movable by this flexure and a receiving part 6 contacted by this contact part 7 are provided to the open-close operation part 5 so as to face each other. The contact part 7 is flexibly moved and brought nearer to the receiving part 6 by increasing the closing force. The contact part 7 contacts the receiving part 6 when the closing force reaches a predetermined value. If the closing force applied to the open-close operation part 5 then continues to be increased further, the proximal end side past the contact part 7 further flexes according to the increase in closing force. However, this increasing closing force is not transmitted to the open-close working part 4, and a holding force or cutting force equal to or greater than a peak value holding force corresponding to the closing force of the predetermined value or greater at the time of contact between the contact part 7 and the receiving part 6 is not transmitted to the object 3.

Specifically, the first half member 1 and the second half member 2 are members composed of a suitable material, e.g., a metal or synthetic resin formed into predetermined shapes. Both member have the open-close working part 4 as a holding part for holding the object 3 provided at the distal ends thereof, the open-close operation part 5 for opening and closing the open-close working part 4 provided at the proximal ends, and a pivotally fitting part 9 provided in a position at the border between the open-close working part 4 and the open-close operation part 5. In the present example, the open-close working part 4 and the open-close operation part 5 are formed integrally. In the present example, the first half member 1 and the second half member 2 are configured as being integrally molded as described above, but the open-close working part 4 and the open-close operation part 5 may also be configured so as to be capable of separating.

Specifically, the open-close working part 4 is configured from the distal ends of the first half member 1 and second half member 2 for holding the object 3 by a closing action in which the gap is narrowed by using the hand to grip or using the fingertips to hold the open-close operation part 5, in which the proximal end of the first half member 1 and the proximal end of the second half member 2 are provided facing each other, and applying closing force which presses inward. In the present example, the open-close working part 4 is formed into a holding part for holding the object 3, but a cutting blade may also be provided to this distal end to form a cutting part for cutting the object 3, and this configuration can be suitably used as long as it exhibits the characteristics of the present example.

The open-close operation part 5 for opening and closing the open-close working part 4 is configured such that the overall shape is formed into a curved shape which is outwardly convex, finger slots 11 where the fingers are inserted for squeezing are provided to the proximal ends, and flexible moving parts 8 are provided to the distal ends. The points where the fingers are inserted in the finger slots 11 to apply closing force constitute pressure points 10. The open-close working part 4 closes and holds the object 3 due to closing force applied by the fingertips squeezing the pressure points 10. The flexible moving parts 8 are flexibly deformed by the reaction of the holding force whereby the open-close working part 4 holds the object 3, causing the open-close operation part 5 to flex or move.

Specifically, the implement is configured such that the finger slots 11 are formed into circular shapes having diameters through which fingertips can be inserted. By inserting fingertips through the finger slots 11 thus formed into circular shapes and operating the open-close operation part 5, two fingers can be used to perform not only a closing operation of applying inward closing force, but also an operation of widening the open-close operation part 5 outward.

Figure 14:
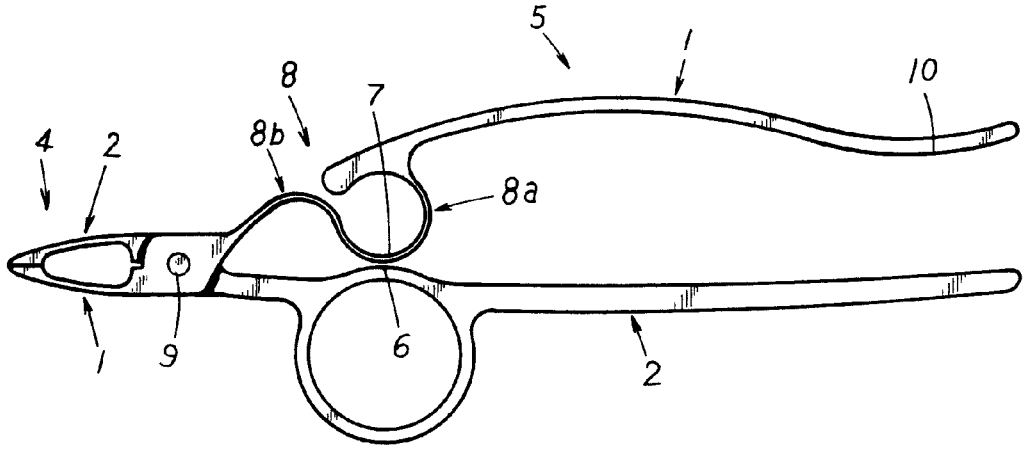
FIG. 14 is a front view showing another example.

The shapes of the finger slots 11 are not limited to the circular shapes shown in the present example and may be inward curving shapes or linear shapes as shown in FIG. 14. This configuration can be suitably employed as long as it exhibits the characteristics of the present example or similar characteristics.

The present example is configured such that the finger slots 11 are provided and squeezed by the fingertips, but may also be configured such that no finger slots 11 are provided and the open-close operation part 5 is gripped, or configured so as to be operated by a machine, a device, a robot, or the like instead of being operated by human hands or fingertips, in which case the configuration can be suitably modified.

The flexible moving parts 8 are specifically configured such that aluminum plates or SUS plates are curved and formed into substantial S shapes, and the flexible moving parts 8 are provided respectively to the first half member 1 and the second half member 2. In this manner, when the first half member 1 and the second half member 2 are bonded and pivotally fitted together, the flexible moving part 8 of the first half member 1 and the flexible moving part 8 of the second half member 2 face each other in bilateral symmetry.

To give a more specific description, the flexible moving parts 8 are composed of proximal-end curved parts 8*a* which are inwardly convex and distal-end curved parts 8*b* which are outwardly convex. One end of each proximal-end curved part 8*a* protrudes inward from a position slightly more proximal than the distal ends of the open-close operation part 5. On the other hand, the other end is curved so as to describe a circle toward the distal end of the first half member 1 or second half member 2, i.e., toward the open-close working part 4, thus forming each proximal-end curved part 8*a*. The other end of each proximal-end curved part 8*a* is curved so as to be outwardly convex, forming each distal-end curved part 8*b*. The distal-end curved parts 8*b* are both connected at one end to the pivotally fitting part 9.

Figure 7:
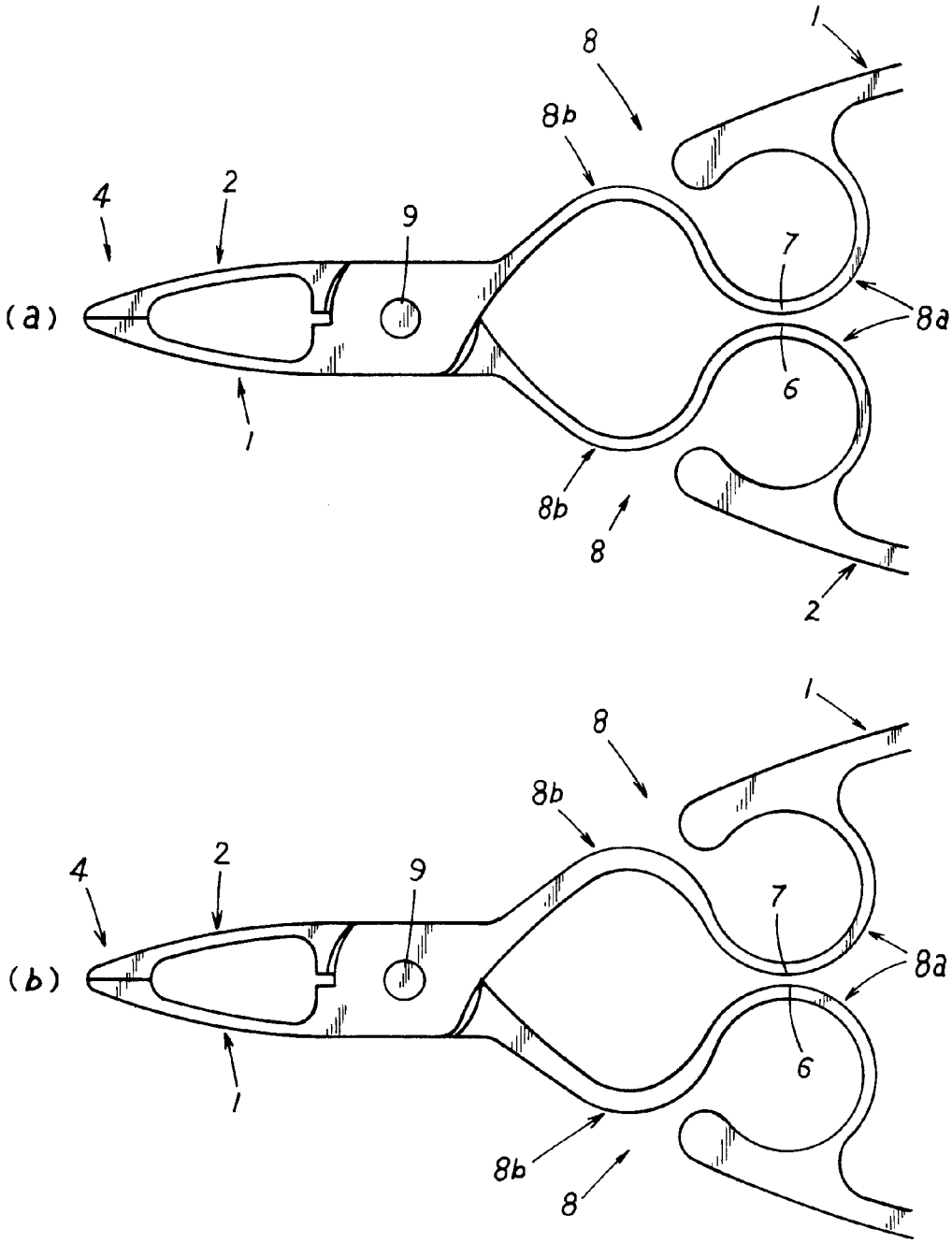
FIG. 7 is a front view showing an example of the configuration of the flexible moving parts of the present example.

The flexible moving parts 8 may also be configured with less thickness as shown in FIG. 7(*a*) or greater thickness as shown in FIG. 7(*b*). The extent to which the flexible moving parts 8 flexibly deform can be changed by changing the thickness of the flexible moving parts 8 in this manner.

Figure 13:
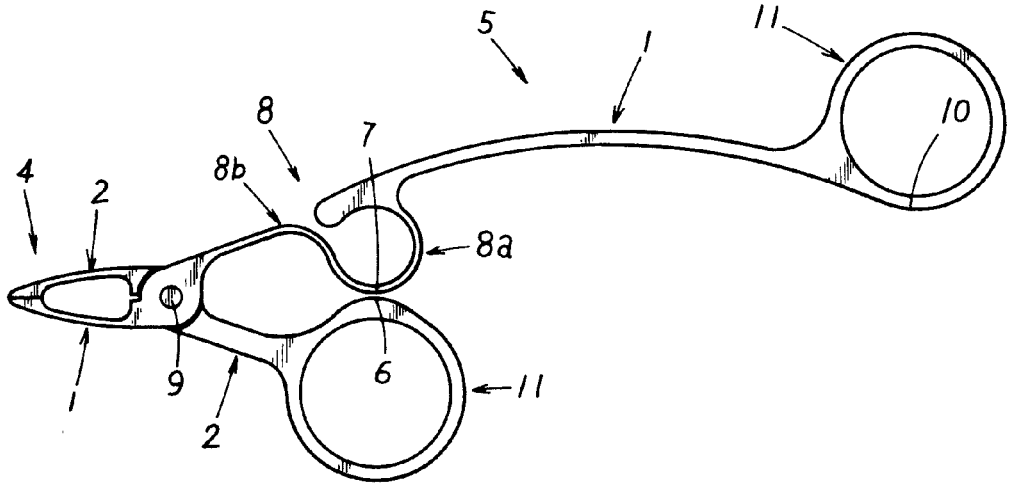
FIG. 13 is a front view showing another example.

The present example is configured with flexible moving parts 8 provided to both the first half member 1 and the second half member 2, but may be configured with a flexible moving part 8 provided to only the first half member 1 or only the second half member 2 as shown in FIGS. 13 and 14. The flexible moving parts 8 are also not limited to the materials and shapes described above. For example, they may be rod-shaped, their thickness and diameter may be appropriately set so as to achieve a desired flexure, holes may be formed to adjust flexure, the materials may be varied (e.g., a synthetic resin or the like), or other modifications may be made. All of these options can be suitably employed as long as they exhibit the characteristics of the present example.

The contact part 7 is provided to one proximal-end curved part 8*a* of these opposing flexible moving parts 8, and the receiving part 6 is provided to the other proximal-end curved part 8*a*.

Specifically, in the present example, the contact part 7 and the receiving part 6 are designed so that when increasing closing force is applied to the open-close operation part 5, the flexible moving parts 8 provided facing each other are thereby flexibly deformed inward towards each other, and the closing force applied to the open-close operation part 5 reaches a predetermined value. One point of contact is the contact part 7 while the other is the receiving part 6. The present example is configured such that the contact point in the first half member is the contact part 7, the contact point in the second half member 2 is the receiving part 6. Both contact points are near the positions (points) where the proximal-end curved parts 8*a* protrude inward the farthest.

The contact part 7 and the receiving part 6 are configured to as to not come in contact when the open-close working part 4 is merely closed without holding an object 3. In other words, the contact part 7 and the receiving part 6 are configured to have a predetermined gap provided in between when the open-close working part 4 is completely closed, i.e., when the distal end of the first half member 1 and the distal end of the second half member 2 are in contact. The contact part 7 and the receiving part 6 are configured so as to come in contact due to the flexible moving parts 8 flexing.

Figure 8:
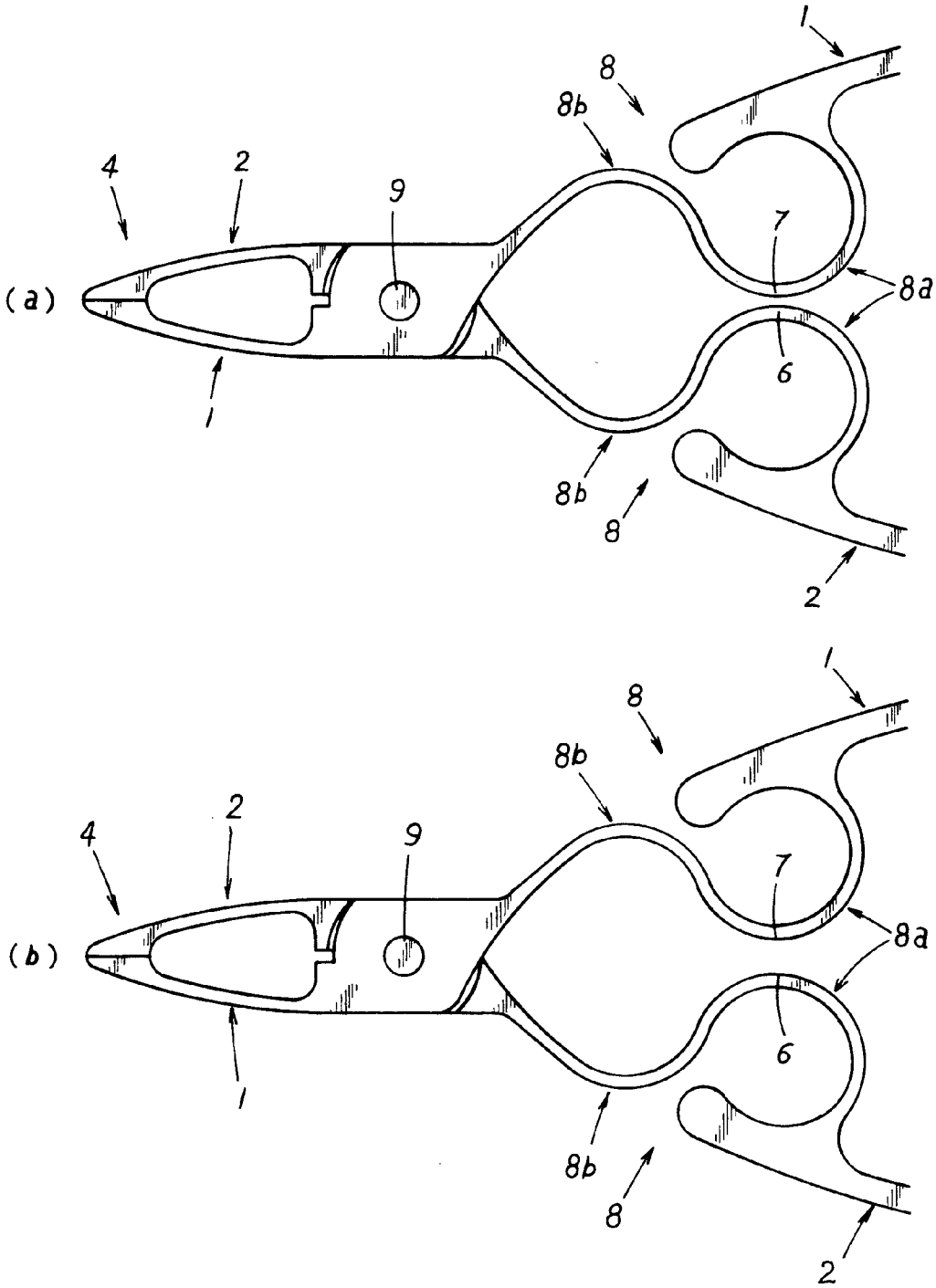
FIG. 8 is a front view showing an example of the configuration of the gap between the contact part and the receiving part of the present example.

The gap between the contact part 7 and the receiving part 6 may be configured either so as to be small as shown in FIG. 8(*a*) or so as to be large as shown in FIG. 8(*b*). By changing the gap between the contact part 7 and the receiving part 6 in this manner, the closing force applied to the open-close operation part 5 changes from the time the flexible moving parts 8 begin to flexibly deform until the contact part 7 and the receiving part 6 come in contact. The holding force transmitted to the open-close working part 4 can therefore be varied.

Specifically, when the holding force for holding the object 3 is small, the gap between the contact part 7 and the receiving part 6 is designed to be small and the contact part 7 and the receiving part 6 come in contact sooner so that the closing force of the open-close operation part 5 is not transmitted to the open-close working part 4. Conversely, when an object must be held with a large holding force, the gap between the contact part 7 and the receiving part 6 may be larger, and the gap between the contact part 7 and the receiving part 6 can be suitably set and varied so that the holding force appropriately corresponds to the object 3 being held.

The actions and effects of the present example configured as described above are described hereinbelow.

FIGS. 3 to 6 are drawings showing the present example in a state of use, i.e., the state of the present example when an object 3 is held by the open-close working part 4 and closing force is being applied to the open-close operation part 5.

Figure 3:
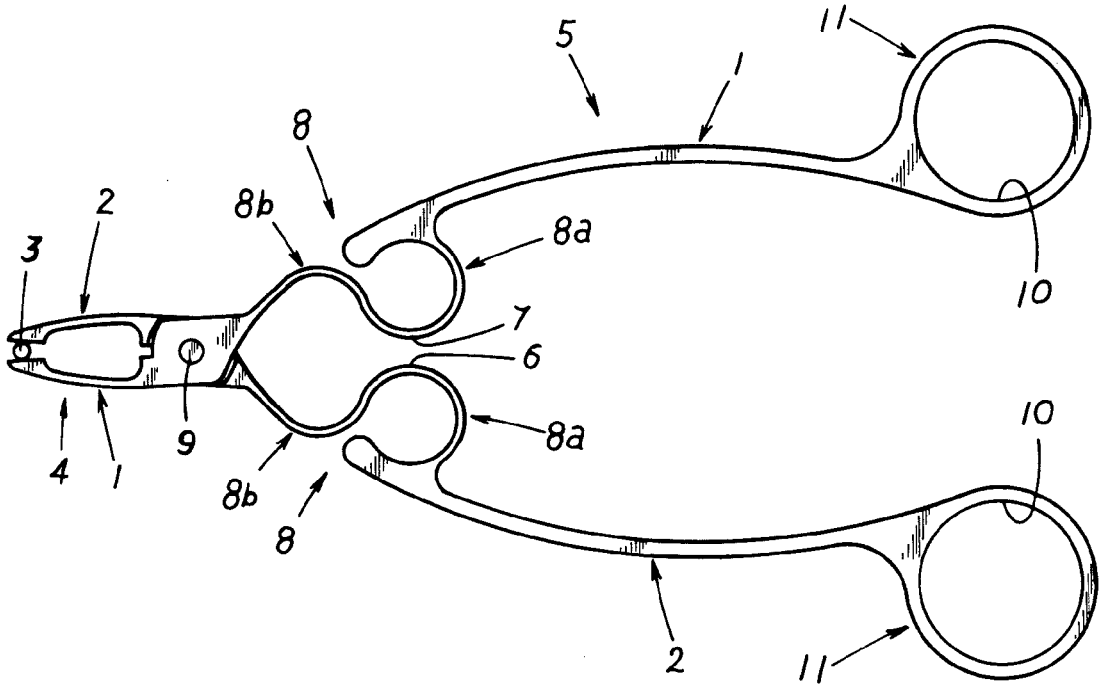
FIG. 3 is an explanatory front view showing the present example in a state of use.
Figure 4:
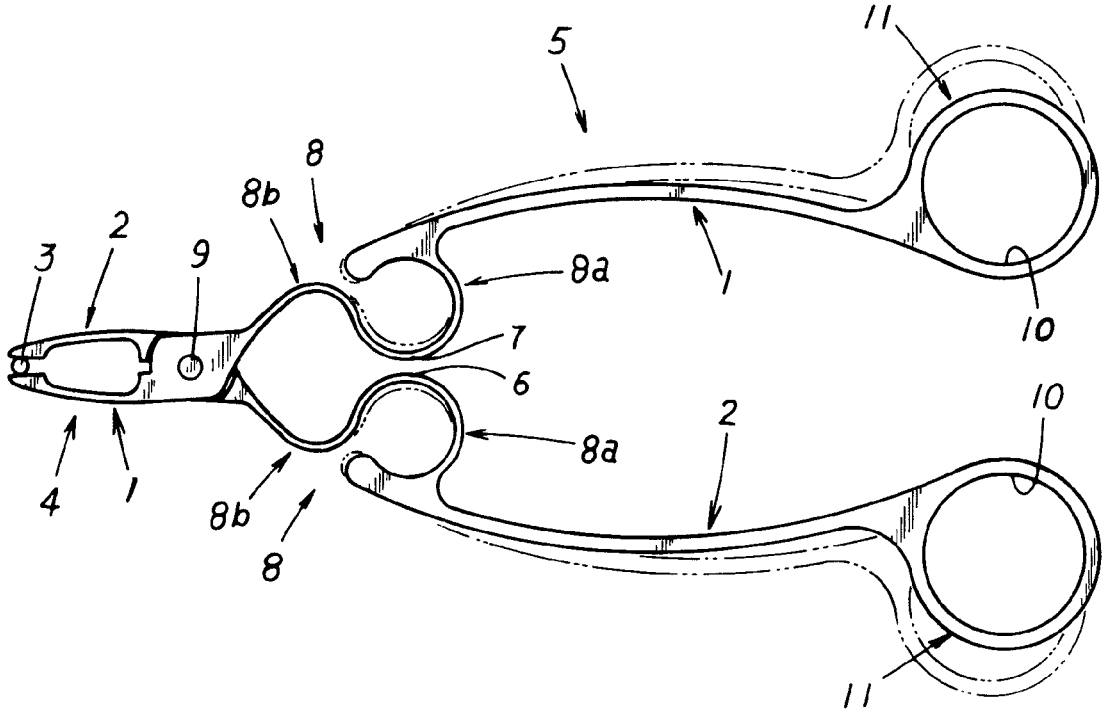
FIG. 4 is an explanatory front view showing the present example in a state of use.

Specifically, FIG. 3 is a drawing showing an object 3 being held by the open-close working part 4. When increasing closing force is applied to the pressure points 10 of the finger slots 11 while the object 3 is being held by the open-close working part 4, the flexible moving parts 8 flexibly deform inward as shown in FIG. 4. As the open-close operation part 5 flexes inward, the contact part 7 and the receiving part 6 provided to the proximal-end curved parts 8*a* of the flexible moving parts 8 begin to draw together.

When increasing closing force is then applied to the pressure points 10, the flexible moving parts 8 flexibly deform further inward, the contact part 7 and the receiving part 6 draw nearer together, and the open-close operation part 5 flexes further inward. When the closing force reaches a predetermined value, the contact part 7 and the receiving part 6 come in contact as shown in FIG. 5.

Figure 5:
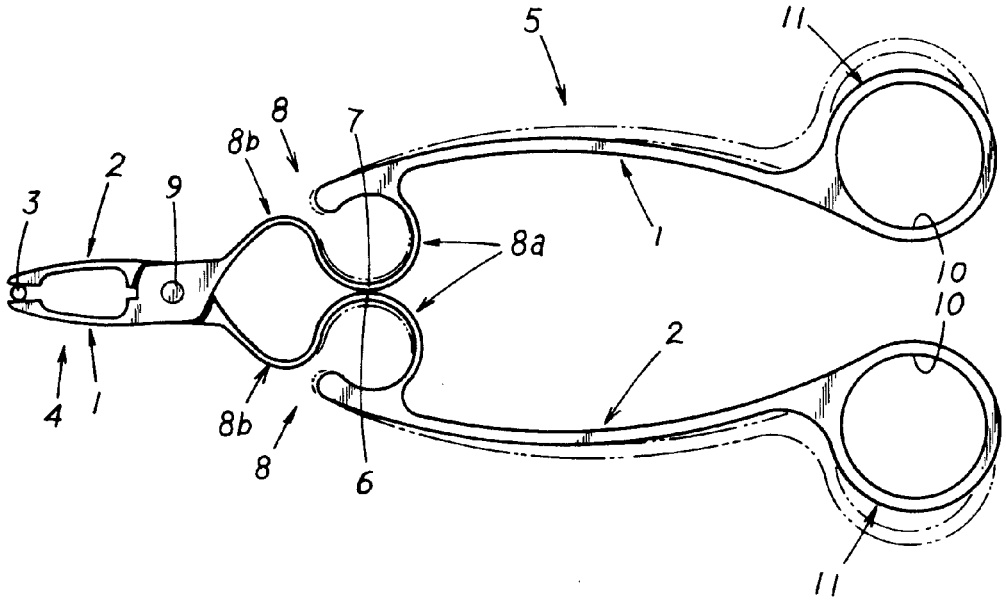
FIG. 5 is an explanatory front view showing the present example in a state of use.

In the states shown in FIGS. 3 to 5, the closing force applied to the open-close operation part 5 (the pressure points of the finger slots 11) is transmitted to the open-close working part 4, a holding force is generated by the principle of leverage in the open-close working part 4 which corresponds to the closing force applied to the open-close operation part 5, and the object 3 is held by the holding force corresponding to this applied closing force.

Figure 6:
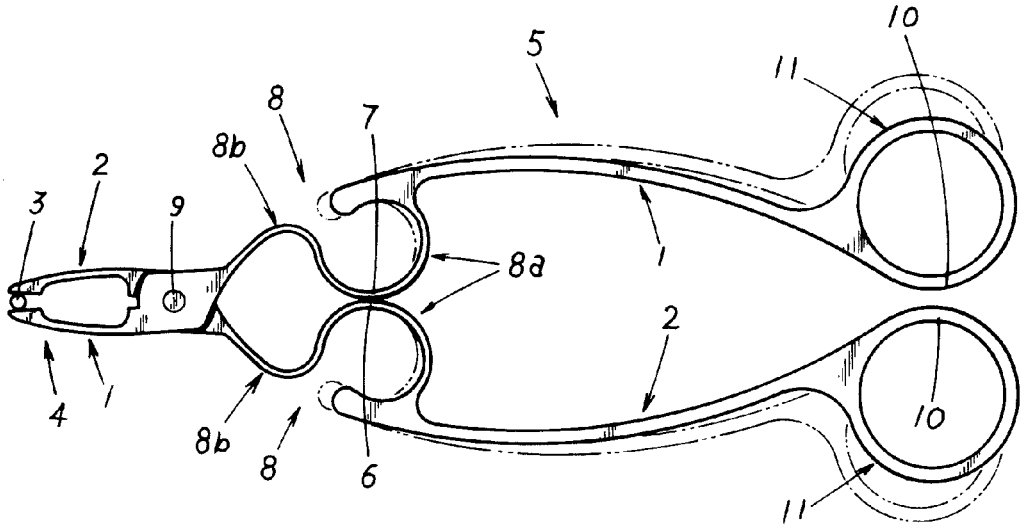
FIG. 6 is an explanatory front view showing the present example in a state of use.

When the contact part 7 and the receiving part 6 are in this state of contact and increasing closing force continues to be applied to the open-close operation part 5, the flexible moving parts 8 flexibly deform further inward and the open-close operation part 5 flexes further inward as shown in FIG. 6. However, due to the contact part 7 and the receiving part 6 being in contact, there is no further closing action exerted in the distal ends past the contact point between the contact part 7 and the receiving part 6. Therefore, holding force corresponding to the increasing closing force applied to the open-close operation part 5 is not generated in the open-close working part 4, and the holding force of the open-close working part 4 either decreases or remains the same holding force at the point in time when the contact part 7 and the receiving part 6 came in contact.

The present example is configured so that the flexible moving parts 8 are formed into substantial S shapes in which inwardly convex proximal-end curved parts 8*a* and outwardly convex distal-end curved parts 8*b* are connected. Increasing closing force is applied to the open-close operation part 5, and either the proximal-end curved parts 8*a* or the distal-end curved parts 8*b* flexibly deform inward until the closing force applied to the open-close operation part 5 reaches a predetermined value and the contact part 7 and the receiving part 6 come in contact. However, when closing force equal to or greater than the predetermined value is further applied to the open-close operation part 5 after the contact part 7 and the receiving part have come in contact, the proximal end of the proximal-end curved part 8*a* past the contact part 7 (the receiving part 6) flexibly deforms further inward. This flexible deformation of the proximal end of the proximal-end curved part 8*a* causes an outward pressing force to act on the distal end of the proximal-end curved part 8*a* past the contact part 7 (the receiving part 6).

The distal ends of the proximal-end curved parts 8*a* being pressed outward yields a force which presses the distal-end curved parts 8*b* in an outward opening direction, whereby the open-close working part 4 moves in an opening direction and the holding force holding the object 3 decreases.

Figure 9:
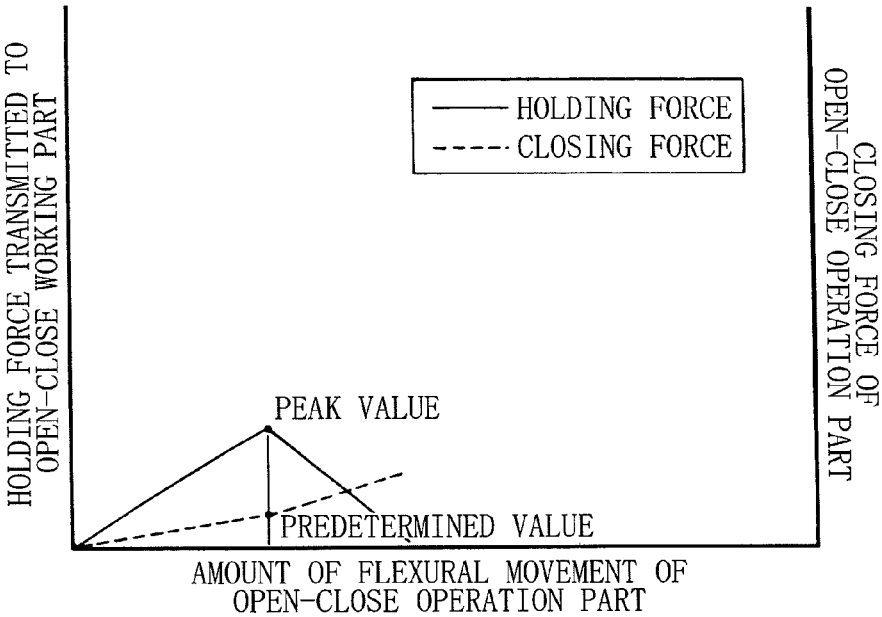
FIG. 9 is a graph showing the relationship between the closing force applied to the open-close operation part, the amount of flexural movement of the open-close operation part when this closing force is applied, and the holding force transmitted to the open-close working part, when the flexible moving parts of the present example are small in thickness and the gap between the contact part and the receiving part is small.
Figure 10:
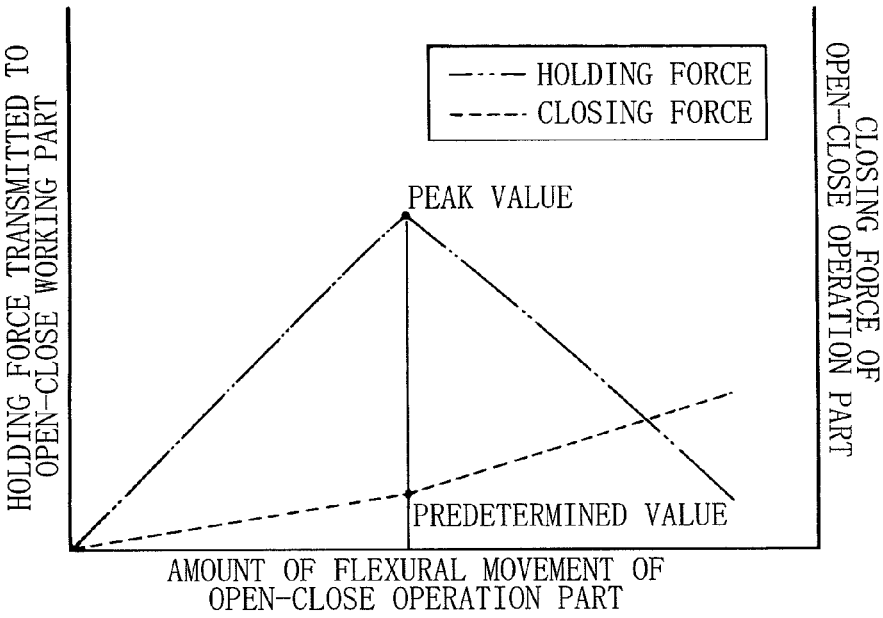
FIG. 10 is a graph showing the relationship between the closing force applied to the open-close operation part, the amount of flexural movement of the open-close operation part when this closing force is applied, and the holding force transmitted to the open-close working part, when the flexible moving parts of the present example are large in thickness and the gap between the contact part and the receiving part is small.
Figure 11:
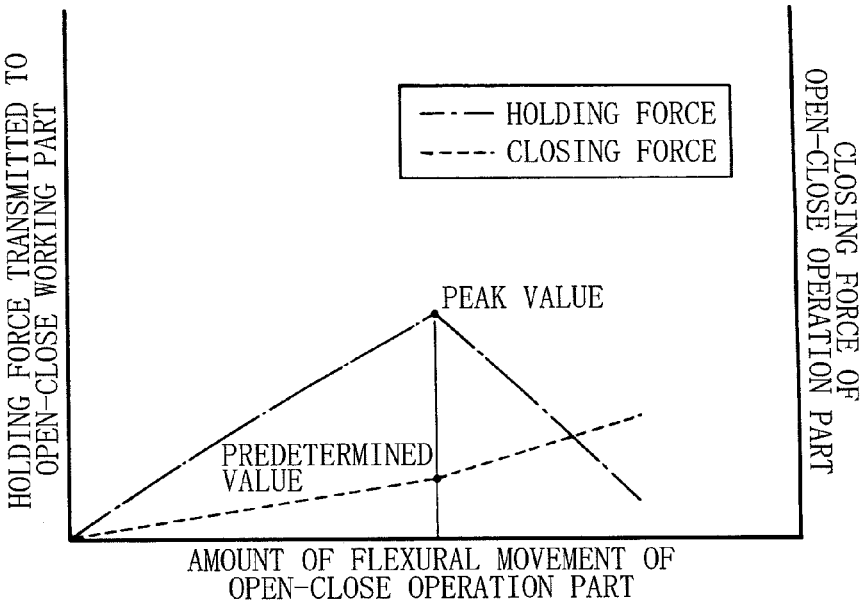
FIG. 11 is a graph showing the relationship between the closing force applied to the open-close operation part, the amount of flexural movement of the open-close operation part when this closing force is applied, and the holding force transmitted to the open-close working part, when the flexible moving parts of the present example are small in thickness and the gap between the contact part and the receiving part is large.
Figure 12:
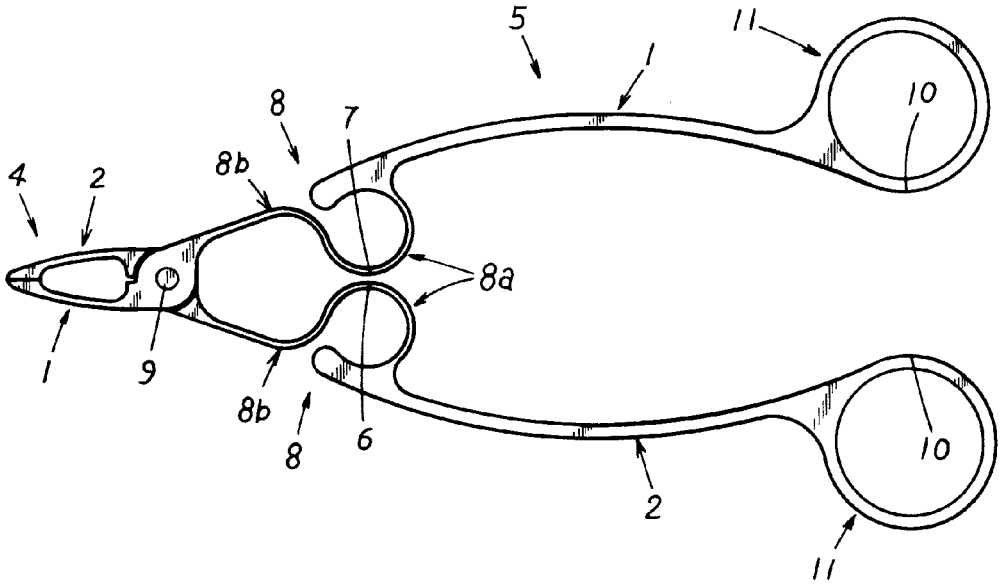
FIG. 12 is a front view showing another example.

Specifically, in the present example, FIGS. 9 to 11 show as the relationship between closing force applied to the open-close operation part, the amount of flexural movement of the open-close operation part when this closing force is applied, and the holding force transmitted to the open-close working part. As indicated by this relationship, when increasing closing force is applied to the open-close operation part 5 while an object 3 is being held in the open-close working part 4, at first the flexible moving parts 8 flexibly deform, causing the open-close operation part 5 to flexibly move inward, and the holding force on the open-close working part 4 increases according to the increasing closing force.

The contact part 7 and the receiving part 6 then come in contact when the closing force applied to the open-close operation part 5 reaches a predetermined value, whereby holding force corresponding to any further increased closing force is not transmitted to the open-close working part 4. The holding force at the time of contact between the contact part 7 and the receiving part 6 is the maximum holding force, i.e., the peak value of the holding force of the open-close working part 4. By continuing to apply increasing closing force to the open-close operation part 5 past this peak value, the open-close working part 4 is conversely moved in the opening direction and the holding force of the open-close working part 4 therefore tends to decrease.

To give a detailed description of FIGS. 9 to 11, FIG. 9 shows the essential configuration of the present example, i.e., a case in which the flexible moving parts 8 are small in thickness and the gap between the contact part 7 and the receiving part 6 is small. FIG. 10 shows a case of this essential configuration in which the gap between the contact part 7 and the receiving part 6 remains the same and the flexible moving parts 8 are large in thickness (twice the thickness).

FIG. 11 shows a case of the above-described essential configuration in which the gap between the contact part 7 and the receiving part 6 is large (a gap twice the normal size).

The present example is designed so that, according to the principle of leverage, when the closing force applied to the open-close operation part 5 is transmitted to the open-close working part 4, the holding force will be five times the applied closing force.

When increasing closing force is applied to the open-close operation part 5 until the closing force applied to the open-close operation part 5 reaches a predetermined value, the amount of flexural movement of the open-close operation part 5 increases steadily, and the holding force whereby the open-close working part 4 holds the object 3 increases at a rate five times that of the closing force.

At the point where the closing force applied to the open-close operation part 5 reaches the predetermined value, the contact part 7 and the receiving part 6 come in contact and the holding force of the open-close working part 4 thereby reaches the peak value. If the closing force on the open-close operation part 5 is increased any further, the holding force decreases.

Starting at the point of contact between the contact part 7 and the receiving part 6, the amount by which the open-close operation part 5 flexibly moves changes depending on the closing force applied to the open-close operation part 5. Specifically, since the open-close operation part 5 does not flex readily, the closing force applied to the open-close operation part 5 must be an even greater closing force for the amount of flexural movement of the open-close operation part 5 to increase at a steady rate.

By continuing to apply increasing closing force to the open-close operation part 5, for example, the holding force whereby the open-close working part 4 holds the object 3 will reach zero at a certain point, the open-close working part 4 will no longer be able to hold the object 3, and a state will arise in which the object 3 is released from the open-close working part 4.

Specifically, a common open-close work implement performs two operations, one being applying force in a closing direction to the open-close operation part 5 in order to close the open-close working part 4 in the case of an object 3 being held by the open-close working part 4; and the other being applying force in an opening direction to the open-close operation part 5 in the case of the object 3 being released from the open-close working part 4. However, the present example can be operated with merely a single operation, i.e., with one action of applying force in a closing direction to the open-close operation part 5 both when the object 3 is held and when the object 3 is released.

Therefore, when the open-close work implement of the present example is used to hold an object 3 having a delicate structure, such that there is concern over the object being crushed, destroyed, or scratched on the surface by the holding operation, the implement is configured such that the contact part 7 and the receiving part 6 come in contact when a predetermined closing force is applied which yields a holding force in the open-close working part 4 that does not crush, destroy, or scratch the surface of the object 3 and that is capable of sufficiently holding the object. There is thus no need to carefully operate the implement while adjusting the closing operation of the open-close operation part 5 with delicate closing force so as to avoid crushing, breaking, or scratching the surface of the object 3 with the open-close working part 4, and an object 3 with a delicate structure such as is described above can be held in a simple manner without crushing, breaking, or scratching the surface of the object 3 merely by performing an extremely simple operation of gripping or squeezing with the fingertips, for example. Therefore, the operation is easy does not require much concern. Furthermore, the open-close work implement can be operated more speedily than a conventional implement, and the open-close work implement is therefore revolutionary with significantly improved operating efficiency and far superior practicality and operability.

The present invention is not limited to the present example, and specific configurations of various configurational requirements can be suitably designed.

The invention claimed is:

1. An open-close work implement wherein a first half member and a second half member are intersected and pivotally fitted together, the distal ends being provided with an open-close working part for holding or cutting an object, and the proximal ends being provided with an open-close operation part for opening and closing the open-close working part;

said open-close work implement characterized in being configured so that when closing force is applied to the open-close operation part to close the open-close working part and hold or cut the object, the open-close operation part flexes inward as the closing force applied to the open-close operation part is increased while the object is being held; the application of increasing closing force to the open-close operation part is perceived by feeling through a hand gripping the open-close operation part or a hand or fingertips pressing the open-close operation part, or by observing the amount of flexure; flexible moving parts of the open-close operation part are provided with a contact part which draws near a receiving part due to the inward flexure of the open-close operation part and contacts the receiving part when the closing force reaches a predetermined value, and when the closing force is further increased while the receiving part and the contact part are in a state of contact, the portion proximal from the contact part further flexes or moves inward but the increased closing force is not transmitted to the open-close working part, and the holding force holding the object or the cutting force cutting the object does not increase beyond the holding force or cutting force corresponding to the closing force that was being applied to the open-close operation part at the time the receiving part and the contact part came in contact.

2. An open-close work implement wherein a first half member and a second half member constituting a pair are bonded, intersected, and pivotally fitted together at a midway point, the distal ends of the opposing first half member and second half member forming an open-close working part constituting a holding part or cutting part, and the proximal ends of the opposing first half member and second half member forming an open-close operation part for holding or cutting an object when the open-close working part of the distal ends is closed by closing force applied to press the proximal ends towards each other in an inward closing direction; said open-close work implement configured so that when further closing force is applied to the open-close operation part while the object is being held between the distal end of the first half member and the distal end of the second half member constituting the open-close working part, at least the proximal end of the first half member or the proximal end of the second half member flexes inward according to the increase in closing force; said open-close work implement also configured so that a contact part which is moved by the flexure and a receiving part contacted by the contact part are provided facing each other to the open-close operation part, the contact part is flexibly moved toward the receiving part by increasing the closing force, the contact part contacts the receiving part when the closing force reaches a predetermined value, and when the closing force applied to the open-close operation part continues to be increased further, the portion proximal from the contact part further flexes or moves inward according to the increase in closing force but the increased closing force is not transmitted to the open-close working part, and the holding force holding the object or the cutting force cutting the object does not increase beyond the peak value holding force or cutting force corresponding to the closing force that was being applied to the open-close operation part at the time the receiving part and the contact part came in contact.

3. The open-close work implement according to claim 1, characterized in being configured so that the open-close working part is composed of the distal end of the first half member and the distal end of the second half member for holding or cutting the object by performing a closing action in which the open-close operation part, which comprises the proximal end of the first half member and the proximal end of the second half member disposed facing each other, is gripped by a hand or held by fingertips and a gap is narrowed by application of the inward-pressing closing force, and when further closing force is applied to the open-close operation part either while the object is being held between the distal end of the first half member and the distal end of the second half member of the open-close working part, or while the object is being held while being cut, at least the first half member or the second half member of the open-close operation part flexes inward; said open-close work implement also configured so that the contact part is provided to one flexible moving part of the first half member or the second half member of the open-close operation part, the receiving part is provided to the other opposing flexible moving part, the contact part and the receiving part do not come in contact until the open-close working part closes and the object is held, and the flexible moving parts are flexibly deformed by further increasing the closing force holding the object, thereby causing the contact part to draw near and contact the receiving part; wherein the contact part is provided toward the proximal end from a pivotally fitting part where the first half member and the second half member are intersected and pivotally fitted together, and toward the distal end from a pressure point where the closing force is applied when the open-close operation part is gripped or held by fingertips.

4. The open-close work implement according to claim 2, characterized in being configured so that the open-close working part is composed of the distal end of the first half member and the distal end of the second half member for holding or cutting the object by performing a closing action in which the open-close operation part, which comprises the proximal end of the first half member and the proximal end of the second half member disposed facing each other, is gripped by a hand or held by fingertips and a gap is narrowed by application of the inward-pressing closing force, and when further closing force is applied to the open-close operation part either while the object is being held between the distal end of the first half member and the distal end of the second half member of the open-close working part, or while the object is being held while being cut, at least the first half member or the second half member of the open-close operation part flexes inward; wherein the contact part is provided to one flexible moving part of the first half member or the second half member of the open-close operation part, the receiving part is provided to the other opposing flexible moving part, the contact part and the receiving part do not come in contact until the open-close working part closes and the object is held, and the flexible moving parts are flexibly deformed by further increasing the closing force holding the object, thereby causing the contact part to draw near and contact the receiving part; and the contact part is provided toward the proximal end from a pivotally fitting part where the first half member and the second half member are intersected and pivotally fitted together, and toward the distal end from a pressure point where the closing force is applied when the open-close operation part is gripped or held by fingertips.

5. The open-close work implement according to any of claims 1 through 4, characterized in that the portion distal from the pivotally fitting part of the first half member and the second half member constitutes the open-close working part, the proximal portion constitutes the open-close operation part, the contact part is provided near the pivotally fitting part in a state of protruding inward to either the proximal end of the first half member or the proximal end of the second half member which constitute a gripping part or fingertip-holding part of the open-close operation part, and the receiving part which comes in contact with the contact part is provided to the other proximal end.

6. The open-close work implement according to any of claims 2 through 4, characterized in being configured so that closing force applied to the open-close operation part is transmitted to the open-close working part, holding force of the open-close working part for holding the object generated according to the closing force increases according to the increase in the closing force applied to the open-close operation part until the flexible moving parts of the open-close operation part flex and the contact part provided to one flexible moving part draws near and contacts the receiving part, and when the closing force applied to the open-close operation part is further increased beyond the point in time when the contact part and the receiving part come in contact, the holding force does not increase according to the increase in closing force applied to the open-close operation part, but the holding force decreases after reaching a peak value corresponding to a predetermined value of the closing force at the time of contact between the contact part and the receiving part.

7. The open-close work implement according to claim 5, characterized in being configured so that closing force applied to the open-close operation part is transmitted to the open-close working part, holding force of the open-close working part for holding the object generated according to the closing force increases according to the increase in the closing force applied to the open-close operation part until the flexible moving parts of the open-close operation part flex and the contact part provided to one flexible moving part draws near and contacts the receiving part, and when the closing force applied to the open-close operation part is further increased beyond the point in time when the contact part and the receiving part come in contact, the holding force does not increase according to the increase in closing force applied to the open-close operation part, but the holding force decreases after reaching a peak value corresponding to a predetermined value of the closing force at the time of contact between the contact part and the receiving part.

* * * * *

UNITED STATES PATENT AND TRADEMARK OFFICE

CERTIFICATE OF CORRECTION

PATENT NO. : 8,863,623 B2
APPLICATION NO. : 13/395774
DATED : October 21, 2014
INVENTOR(S) : Masami Nashimoto It is certified that error appears in the above-identified patent and that said Letters Patent is hereby corrected as shown below:

In the Specification,

Column 2, line 43, insert --2-- after “member”

Column 4, line 44, delete “manual”

Column 11, line 48, insert --1-- after “member”

Column 12, line 38, insert --10-- after “points”

Column 13, line 5, insert --6-- after “part”

Signed and Sealed this
Nineteenth Day of May, 2015

Michelle K. Lee

Michelle K. Lee
*Director of the United States Patent and Trademark Office*